US006602180B2

(12) United States Patent
Herman et al.

(10) Patent No.: US 6,602,180 B2
(45) Date of Patent: Aug. 5, 2003

(54) SELF-DRIVEN CENTRIFUGE WITH VANE MODULE

(75) Inventors: Peter K. Herman, Cookeville, TN (US); Richard Jensen, deceased, late of Cookeville, TN (US), by Shirley Ann Jensen, executor

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 10/028,619

(22) Filed: Dec. 20, 2001

(65) Prior Publication Data

US 2002/0119883 A1 Aug. 29, 2002

Related U.S. Application Data

(63) Continuation-in-part of application No. 09/542,723, filed on Apr. 4, 2000, now abandoned, and a continuation-in-part of application No. 09/776,378, filed on Feb. 2, 2001, now Pat. No. 6,540,653.

(51) Int. Cl.[7] ..... B04B 1/04; B04B 9/06

(52) U.S. Cl. ..... 494/75; 494/49; 494/64; 494/75; 494/901; 210/168; 184/6.24

(58) Field of Search ..... 210/168, 380.1; 184/6.24; 494/49, 64, 67, 901, 74, 75

(56) References Cited

U.S. PATENT DOCUMENTS

| | | | | |
|---|---|---|---|---|
| 661,943 | A | 11/1900 | Arend | |
| 707,132 | A | 8/1902 | Marsh | |
| 715,493 | A | 12/1902 | Lundstrom | |
| 1,006,622 | A | 10/1911 | Bailey | 494/73 |
| 1,208,960 | A | 12/1916 | Hennerich | |
| 1,719,522 | A | 7/1929 | Sharples | |
| 2,199,849 | A | 5/1940 | Bryson | 233/17 |
| 2,578,485 | A | 12/1951 | Nyrop | 494/41 |
| 2,819,014 | A | 1/1958 | Zabriskie, Jr. | 233/15 |
| 2,941,872 | A | 6/1960 | Pilo et al. | 23/270.5 |
| 3,563,454 | A | 2/1971 | Saget | 233/44 |
| 4,262,841 | A | 4/1981 | Berber et al. | 233/29 |
| 4,353,499 | A | 10/1982 | Simonds | 233/27 |
| 5,575,912 | A | 11/1996 | Herman et al. | 210/380.1 |
| 5,637,217 | A | 6/1997 | Herman et al. | 210/380.1 |
| 6,017,300 | A | 1/2000 | Herman | 494/49 |
| 6,019,717 | A | 2/2000 | Herman | 494/49 |
| 6,074,336 | A | 6/2000 | Purvey | 494/49 |
| 6,183,407 | B1 | 2/2001 | Hallgren et al. | |
| 6,196,962 | B1 | 3/2001 | Purvey et al. | |
| 2001/0029227 | A1 | 10/2001 | Herman et al. | |

FOREIGN PATENT DOCUMENTS

| | | | |
|---|---|---|---|
| EP | 1 142 644 A2 | 10/2001 | |
| GB | 16855 | 8/1904 | |
| GB | 27875 | 12/1904 | |
| GB | 2 077 610 A | 6/1980 | |
| GB | 2 328 891 A | 8/1998 | |
| SE | 18846 | 11/1903 | |
| SU | 721126 | 3/1980 | |
| WO | WO 98/46361 | 10/1998 | B04B/5/00 |
| WO | WO 99/51353 | 10/1999 | |
| WO | WO 00//23194 | 4/2000 | B04B/1/06 |
| WO | WO 01/74492 A2 | 10/2001 | |

*Primary Examiner*—David A. Reifsnyder
(74) *Attorney, Agent, or Firm*—Woodard, Emhardt, Moriarty, McNett & Henry LLP

(57) ABSTRACT

A self-driven centrifuge for separating particulate matter out of a circulating liquid includes a base having a pair of tangential jet nozzles for generating the self-driven force for the centrifuge. Connected to the base is a centrifuge shell which defines a hollow interior space. A hollow rotor hub having a central axis of rotation is assembled to the base and extends through the hollow interior space. A support plate is positioned within the hollow interior space and, in cooperation with the rotor hub, defines an annular flow exit opening for the circulating liquid. Positioned within the hollow interior space is a separation vane module which is constructed and arranged so as to extend around the rotor hub and positioned so as to be supported by the support plate. The separation vane module includes a plurality of axially-extending and spaced-apart separation vanes.

47 Claims, 17 Drawing Sheets

VOLUME AVERAGE RELATIVE VELOCITY MAGNITUDE
(for entire axial length of channel):

0.023 m/s 0.006 m/s 0.021 m/s

SELF-DRIVEN CENTRIFUGE WITH VANE MODULE

CROSS-REFERENCE TO RELATED APPLICATIONS

This application is a continuation-in-part (CIP) patent application of U.S. patent application Ser. No. 09/542,723, filed Apr. 4, 2000, entitled Self Driven Centrifuge with Vane Module, now abandoned, which is incorporated by reference herein in its entirety, and is a CIP patent application of U.S. patent application Ser. No. 09/776,378, filed Feb. 2, 2001, now U.S. Pat. No. 6,540,653.

BACKGROUND OF THE INVENTION

The present invention relates generally to the continuous separation of particulate matter from a flowing liquid by the use of a centrifugal field. More specifically the present invention relates to the use of spiral plates or vanes within the centrifuge bowl in cooperation with a suitable propulsion arrangement for self-driven rotation of the spiral vanes. In one embodiment of the present invention, the propulsion arrangement includes the use of jet nozzles. In other embodiments of the present invention, the specific shape and style of the spiral vanes are modified, including the embodiment of flat (planar) plates.

Since the use of spiral vanes in the preferred embodiment of the present invention is a design change to the prior art technology employing a cone-stack subassembly as the basis for particulate matter separation from the flowing liquid, a review of this cone-stack technology may be helpful in appreciating the differences between the present invention and the prior art and the benefits afforded by the present invention.

U.S. Pat. No. 5, 575,912, which issued Nov. 19, 1996 to Herman et al., discloses a bypass circuit centrifuge for separating particulate matter out of a circulating liquid. The construction of this centrifuge includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly and a pair of oppositely-disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The stacked array of truncated cones is sandwiched between a top plate positioned adjacent to the top portion of the centrifuge bowl and a bottom plate which is positioned closer to the base plate. The incoming liquid flow exits the centertube through a pair of oil inlets and from there flows through the top plate. The top plate in conjunction with ribs on the inside surface of the centrifuge bowl accelerate and direct this flow into the upper portion of the stacked array of truncated cones. As the flow passes radially inward through the channels created between adjacent cones, particle separation occurs. Upon reaching the inner diameter of the cones, the liquid continues to flow downwardly to the tangential flow nozzles.

U.S. Pat. No. 5,637,217, which issued Jun. 10, 1997 to Herman et al., is a continuation-in-part patent based upon U.S. Pat. No. 5,575,912. The U.S. Pat. No. 5,637,217 patent discloses a bypass circuit centrifuge for separating particulate matter out of a circulating liquid. The construction of this centrifuge includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly and a pair of oppositely-disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The incoming liquid flow exits the centertube through a pair of oil inlets and from there is directed into the stacked array of cones. In one embodiment, a top plate in conjunction with ribs on the inside surface of the centrifuge bowl accelerate and direct this flow into the upper portion of the stacked array. In another embodiment the stacked array is arranged as part of a disposable subassembly. In each embodiment, as the flow passes through the channels created between adjacent cones, particle separation occurs as the liquid continues to flow downwardly to the tangential flow nozzles.

U.S. Pat. No. 6,017,300, which issued Jan. 25, 2000 to Herman discloses a cone-stack centrifuge for separating particulate matter out of a circulating liquid. The construction of this centrifuge includes a cone-stack assembly which is configured with a hollow rotor hub and is constructed to rotate about an axis. The cone-stack assembly is mounted onto a shaft centertube which is attached to a hollow base hub of a base assembly. The base assembly further includes a liquid inlet, a first passageway, and a second passageway which is connected to the first passageway. The liquid inlet is connected to the hollow base hub by the first passageway. A bearing arrangement is positioned between the rotor hub and the shaft centertube for rotary motion of the cone-stack assembly. An impulse-turbine wheel is attached to the rotor hub and a flow jet nozzle is positioned so as to be directed at the turbine wheel. The flow jet nozzle is coupled to the second passageway for directing a flow jet of liquid at the turbine wheel in order to impart rotary motion to the cone-stack assembly. The liquid for the flow jet nozzle enters the cone-stack centrifuge by way of the liquid inlet. The same liquid inlet also provides the liquid which is circulated through the cone-stack assembly.

U.S. Pat. No. 6,019,717, which issued Feb. 1, 2000 to Herman is a continuation-in-part patent based upon U.S. Pat. No. 6,017,300. The U.S. Pat. No. 6,019,717 patent discloses a construction which is similar to the construction of the parent patent, but which includes the addition of a honeycomb-like insert which is assembled into the flow jet nozzle in order to reduce inlet turbulence and improve the turbine efficiency.

The increased separation efficiency provided by the inventions of the U.S. Pat. Nos. 5,575,912; 5,637,217; 6,017,300; and 6,019,717 patents is attributed in part to reduced sedimentation distance across the cone-to-cone gap. During the conception of the present invention, it was theoretically concluded that an equivalent effect could be achieved by converting the cone-stack subassembly into a radiating series of spiral vanes or plates with a constant axial cross-section geometry. The spiral vanes of the present invention, as will be described in greater detail herein, are integrally joined to a central hub and a top plate. The preferred embodiment describes this combination of component parts as a unitary and molded combination such that there is a single component. The top plate works in conjunction with acceleration vanes on the inner surface of the shell so as to route the exiting flow from the center portion of the centrifuge to the outer peripheral edge portion of the top plate where flow inlet holes are located. A divider shield located adjacent the outer periphery of the top plate functions to prevent the flow from diverting or bypassing the inlet holes and thereafter enter the spiral vane module through the outside perimeter between the vane gaps. If the flow was permitted to travel in this fashion, it could cause turbulence and some particle re-entrainment, since particles are being ejected in this zone. In the configuration of each spiral vane, the outer peripheral edge is formed with a turbulence shield which extends the full axial length of each spiral vane as a means to further reduce fluid interaction between the outer quiescent sludge collection zone and the gap between adjacent spiral vanes where liquid flow and particle separation are occurring. Following the theoretical conception of the present invention, an actual reduction to practice occurred. Testing was conducted in order to confirm the benefits and improvements offered by the present invention.

The commercial embodiments of the inventions disclosed in the U.S. Pat. Nos. 5,575,912; 5,637,217; 6,017,300; and 6,019,717 patents use a cone-stack subassembly which includes a stack of between twenty and fifty individual cones which must be separately molded, stacked, and aligned before assembly with the liner shell and base plate or, in the case of a disposable rotor design, with the hub or spool portion. This specific configuration results in higher tooling costs due to the need for large multi-cavity molds and higher assembly costs because of the time required to separately stack and align each of the individual cones. The "unitary molded spiral" concept of the present invention enables the replacement of all of the individual cones of the prior art with one molded component. The spiral vanes which comprise the unitary module can be simultaneously injection molded together with the hub portion for the module and the referenced top plate. Alternatively, these individual spiral vanes can be extruded with the hub and then assembled to a separately molded top plate. Even in this alternative approach to the manufacturing method of the present invention, the overall part count would be reduced from between twenty and fifty separate pieces to two pieces.

The present invention provides an alternative design to the aforementioned cone-stack technology. The design novelty and performance benefits of the self-driven, cone-stack designs as disclosed in U.S. Pat. Nos. 5,575,912; 5,637,217; 6,017,300; and 6,019,717 have been demonstrated in actual use. While some of the "keys" to the success of these earlier inventions have been retained in the present invention, namely the self-driven concept and the reduced sedimentation distance across the inter-cone gaps, the basic design has changed. The replacement of the vertical stack of individually molded cones with a single spiral vane module is a significant structural change and is believed to represent a novel and unobvious advance in the art.

SUMMARY OF THE INVENTION

A centrifuge for separating particulate matter out of a liquid which is flowing through the centrifuge according to one embodiment of the present invention comprises a base, a centrifuge shell assembled to the base and defining therewith a hollow interior space, a hollow rotor hub having a central axis of rotation and being assembled into the base and extending through the hollow interior space, a support plate positioned within the hollow interior space and in cooperation with the hollow rotor hub defines a flow exit opening between the support plate and the hollow rotor hub and a separating vane module positioned in the hollow interior space and constructed and arranged so as to extend around the hollow rotor hub and so as to be supported by the support plate, the separation vane module including a plurality of axially-extending and spaced-apart separation vanes.

One object of the present invention is to provide an improved self-driven centrifuge which includes a separation vane module Related objects and advantages of the present invention will be apparent from the following description.

DESCRIPTION OF THE PREFERRED EMBODIMENTS

Figure 1:
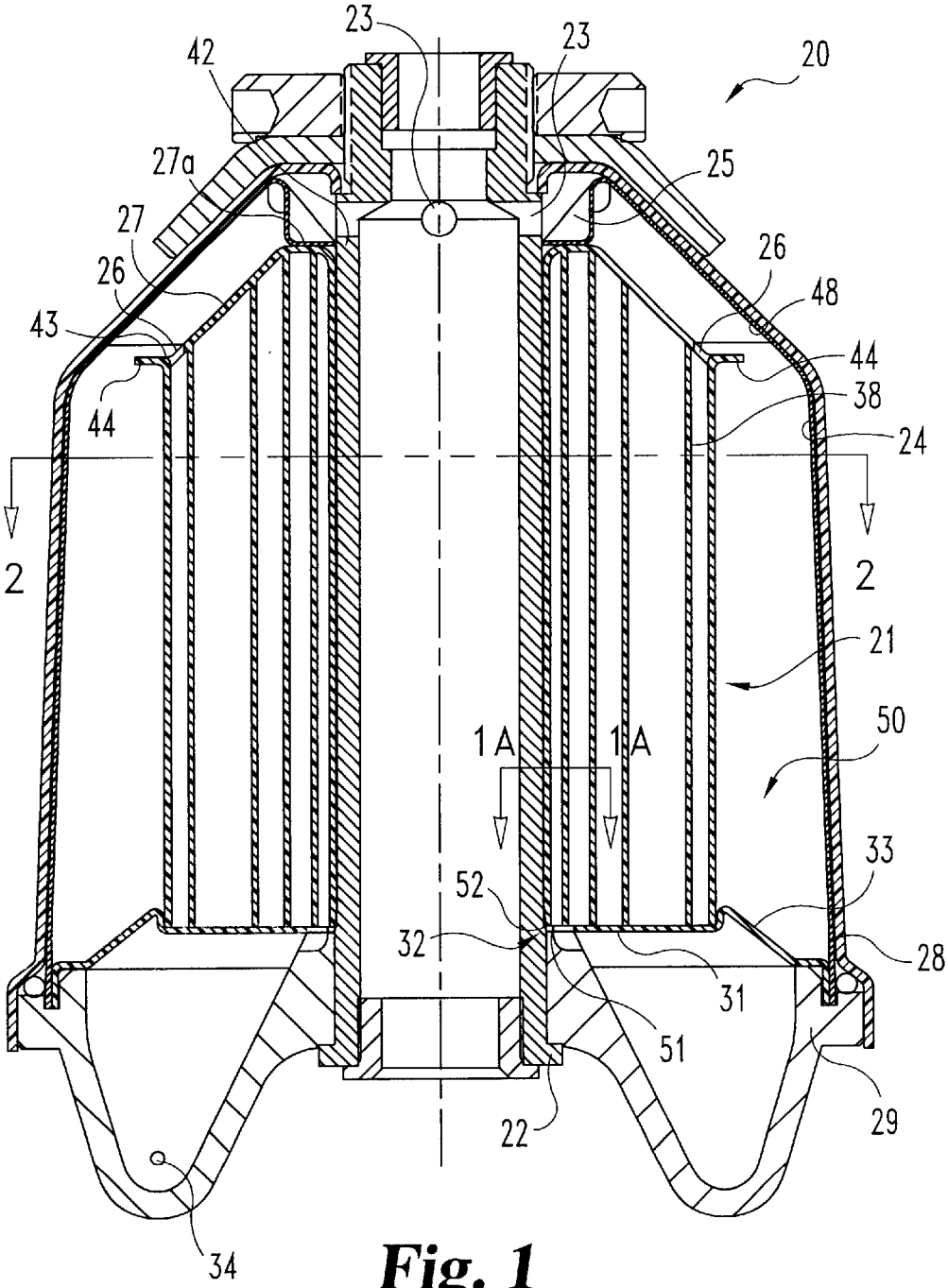
FIG. 1 is a front elevational view in full section of a self-driven centrifuge according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
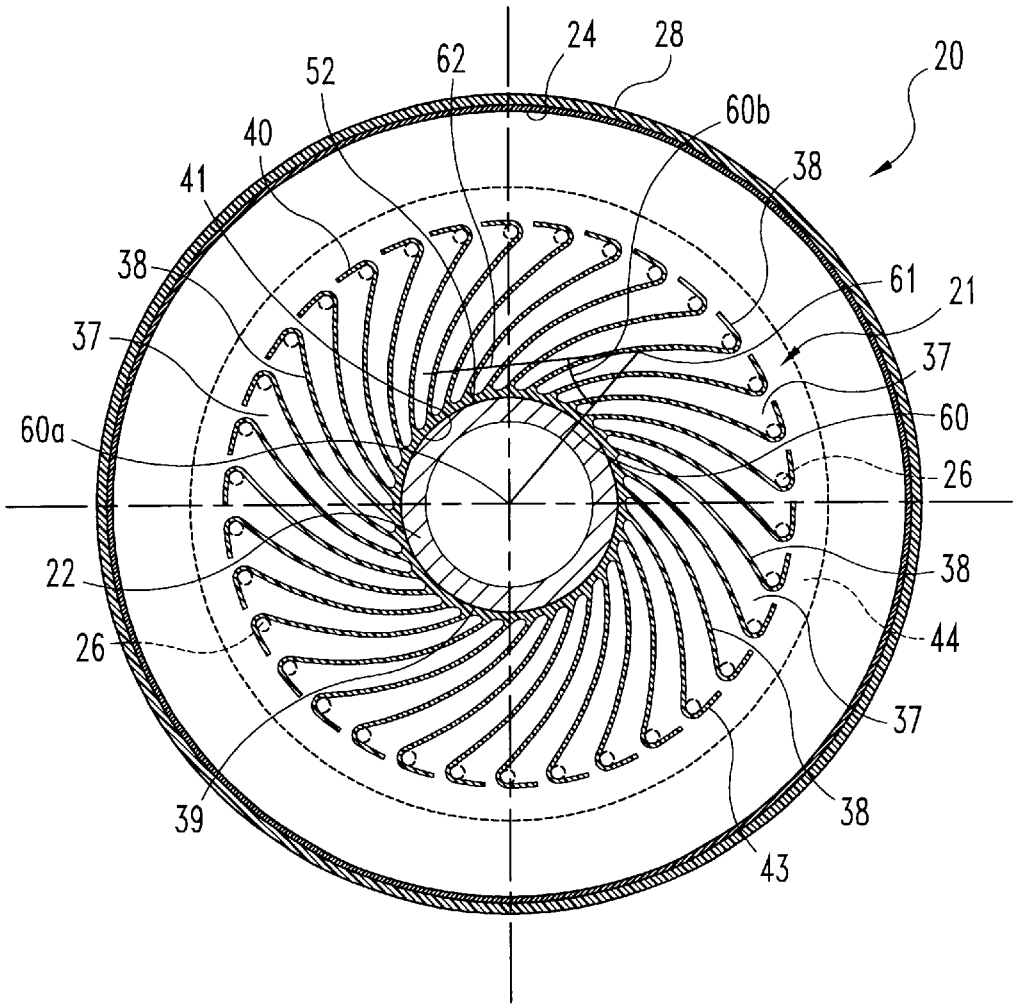
FIG. 2 is a top plan view in full section of the FIG. 1 centrifuge as viewed along line 2—2 in FIG. 1.

Referring to FIGS. 1 and 2, there is illustrated a self-driven centrifuge 20 with a unitary, spiral vane module 21, which replaces the cone-stack subassembly of earlier designs, such as those earlier designs disclosed in U.S. Pat. Nos. 5,575,912; 5,637,217; 6,017,300; and 6,019,717. U.S. Pat. No. 5,575,912 which issued Nov. 19, 1996 to Herman et al. is hereby incorporated by reference. U.S. Pat. No. 5,637,217 which issued Jun. 10, 1997 to Herman et al. is hereby incorporated by reference. U.S. Pat. No. 6,017,300 which issued Jan. 25, 2000 to Herman is hereby incorporated by reference. U.S. Pat. No. 6,019,717 which issued Feb. 1, 2000 to Herman is hereby incorporated by reference.

A majority of the overall packaging and construction for centrifuge 20 is the same as that disclosed in the two referenced United States patents. The noted difference is the replacement of the prior art cone-stack subassembly by the spiral vane module 21 of the present invention. Other minor structural changes are included in order to accommodate the spiral vane module 21 as illustrated in the partial side-by-side comparison in FIG. 6.

Centrifuge 20 operates in a manner very similar to that described in the '912 and '217 patents in that it receives an incoming flow of liquid, typically oil, through an inlet opening in a corresponding supporting base (not illustrated). A connecting passage in that base allows the liquid to flow into the hollow interior of the rotor hub which may also be described as a bearing tube 22. The liquid then flows upwardly until reaching the top tube apertures 23. There are typically four apertures 23 which are equally spaced around the upper circumferential surface of tube 22. The liquid exits through these apertures 23 and flows radially outwardly as it enters the vicinity of the spiral vane module 21. The upper portion of the liner 24 is configured with integrally molded acceleration vanes 25 which cooperate to define flow channels (one channel between each adjacent pair of acceleration vanes). These acceleration vanes, typically four, six, or eight on equal spacing, facilitate the radially outward flow of the oil (or other liquid) and deliver the liquid flow to the location of inlet holes 26 which are molded into top plate 27 of the spiral vane module 21. The liner 24 is encased by shell 28 which is assembled to base 29. The liquid enters the inlet holes 26 and flows through the spiral vane module 21 ultimately exiting at the lower edge 31 of module 21. At this point, the flow passes through the annular clearance space 32 between the supporting base plate 33 and the outer surface of the bearing tube 22 or rotor hub. The exiting flow continues on to the two flow jet orifices 34 (only one being visible in the section view). These two flow jet orifices represent the interior openings for two tangentially directed jet flow nozzles. The high velocity jet which exits from each nozzle orifice generates a reaction torque which in turn drives (rotates) the centrifuge 20 at a sufficiently high rate of between 3000 and 6000 rpm in order to achieve particle separation within the spiral vane module concurrently with the flow of the liquid through the spiral vane module 21. The liquid flow through centrifuge 20, including the specific flow path and the use of the exiting liquid for self-driving of centrifuge 20, is basically the same as what is disclosed in U.S. Pat. Nos. 5,575,912; 5,637,217; 6,017,300; and 6,019,717 with the important exception of what occurs within the spiral vane module 21 and with the important exception of the construction of module 21 which is strikingly different from the cone-stack subassembly construction as depicted in the '912 and '217 patents.

With continued reference to FIGS. 1 and 2, the spiral vane module 21 is positioned within the liner 24 in basically the same location occupied by the prior art cone-stack subassembly. The module 21 includes top plate 27 and a series of identically configured and equally-spaced (see gap 37) spiral vanes 38. The concept of "equally-spaced" refers only to a uniform pattern from spiral vane to spiral vane and not through the space or gap defined by adjacent vanes moving in an outward radial direction. The space or gap 37 between adjacent vanes 38 gradually becomes larger (i.e., circumferentially wider) when moving radially outward from the location of the inner hub portion 39 to the outermost edge 40.

The entire spiral vane module 21 is molded out of plastic as a unitary, single-piece component. The individual vanes 38 are joined along their inner edge into a form of centertube or hub portion 39 which is designed to slide over the bearing tube or what is also called the centrifuge rotor hub 22. By properly sizing the inside diameter 41 of the hub portion 39 relative to the outside diameter of the rotor hub, it is possible to create a closely toleranced and concentric fit. This in turn contributes to the overall balance which is desired due to the rate at which the centrifuge rotates.

The spiral vane module 21 is annular in form with the individual spiral vanes 38 (34 total) being arranged so as to create a generally cylindrical form. The molded hub portion 39 is cylindrical as well. The top plate 27 is generally conical in form, though it does include a substantially flat annular ring portion 27*a* surrounding the hollow interior 42. It is also envisioned that this top plate 27 geometry could have a hemispherical upper surface. Also included as part of module 21 and located adjacent to outer peripheral edge 43 of the top plate 27 is a divider shield 44. Divider shield 44 also has an annular ring shape and extends in a horizontal direction radially outwardly. The plurality of inlet holes 26 molded into top plate 27 are located adjacent the outer peripheral edge 43 of the top plate which is also adjacent and close to where shield 44 begins. In the section view of FIG. 2, the inlet holes 26 and shield 44 are shown in broken line form since they are actually above the cutting plane 2—2. The broken line form is used to diagrammatically illustrate where these features are located relative to the vanes 38.

The flow of liquid exiting the tube apertures 23 and from there being routed in the direction of the inlet holes 26 is actually "dropped off" by the acceleration vanes 25 at a location (radially) corresponding to the inlet holes 26. The flow passes through the top plate 27 by way of these inlet holes wherein there is one hole corresponding to each separation gap 37 between each pair of adjacent spiral vanes 38. As the flow passes through the inlet holes and into each gap 37, it flows through the gaps in a radially inward and axially downward direction due to the location of the flow exit between the outer surface of the rotor hub and the inner edge of the base plate. The flow dynamics are such that the flow exiting from the tube apertures 23 tends to be evenly distributed across the surface of the top plate and thus equally distributed through the thirty-four inlet holes 26. As described, there is one inlet hole corresponding to each gap and one gap corresponding to each vane 38. As the flow of liquid travels through each gap 37 from the outer and wider point to the inner and more narrow point adjacent the rotor hub, the centrifugal force due to the high rate of rotation of the centrifuge acts upon the heavier particulate matter, allowing it to gradually migrate in a radially outward direction, collecting on the concave surface of the spiral vane and continues to slip outward, where it ultimately exits from the module and accumulates in a sludge collection zone located between the outer periphery of the module 21 and the inner surface of liner shell 24. One possible particulate path for particle 45 is diagrammatically illustrated in FIG. 5.

The divider shield 44 extends in an outward radial direction from the approximate location of the inlet holes 26 to a location near, but not touching, the inside surface 48 of the liner 24. The divider shield 44 prevents flow from bypassing around the inlet holes 26 and thereby disturbing the quiescent zone 50 where sludge (i.e., the separated particulate matter and some oil) is being collected. By preventing the flow from disturbing the quiescent zone 50, the design of the present invention also prevents to a great extent the re-entrainment of particulate matter which has already been separated from the flowing liquid. The concept of re-entrainment involves loosening or picking up some of the particulate matter already separated from the liquid flow and allowing it to go back into the liquid, thereby undoing the work which had already been done. It is also to be noted that the distance of separation between the divider shield 44 and the inside surface 48 of liner 24 is large enough to permit larger particulate matter that might be separated in the region of the acceleration vanes 25 to be discharged into the quiescent zone 50.

Figure 1A:
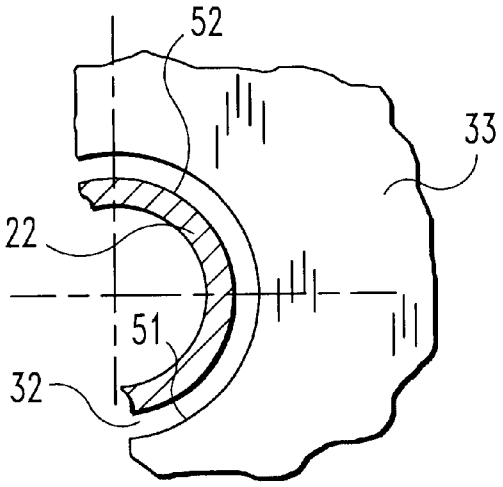
FIG. 1A is a partial, top plan section view of the FIG. 1 centrifuge as viewed along line 1A—1A.

As the flow of liquid passes through the inlet holes 26 and into the separation gaps 37, it spreads out within the gaps and proceeds inward radially and axially downward toward the lower edge 31 where the flow exits by way of clearance space 32. The flow is prevented from bypassing the designed flow through gaps 37 by the use of base plate 33 which closes off any other exit path for the flow except for the flow opening provided by the clearance space 32 which is defined by the inner circular edge 51 of the base plate 33 and the outer surface 52 of bearing tube 22 or what has been called the rotor hub (see FIG. 1A).

Figure 1B:
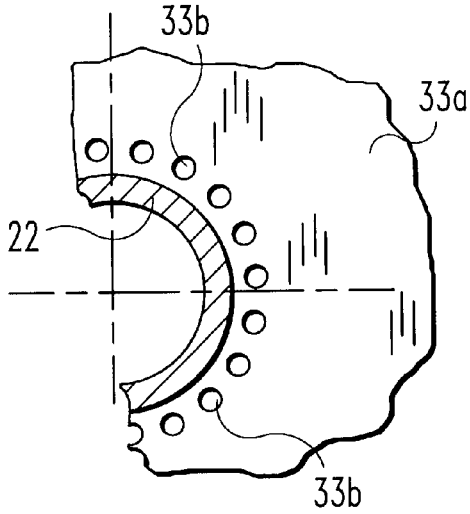
FIG. 1B is a partial, top plan section view of an alternate embodiment of the present invention using the sight line 1A—1A in FIG. 1.

In an alternative embodiment of the present invention (see FIG. 1B), the base plate 33*a* extends into contact with bearing tube 22 such that clearance space 32 is closed. In order to provide a flow path, a plurality of clearance holes 33*b* are created in base plate 33*a* at approximately the same location of clearance space 32. The individual vanes 38 have been omitted from the section views of FIGS. 1A and 1B for drawing simplicity. In lieu of circular holes 33*b,* virtually any type of opening can be used, including radial and/or circumferential slots.

Figure 3:
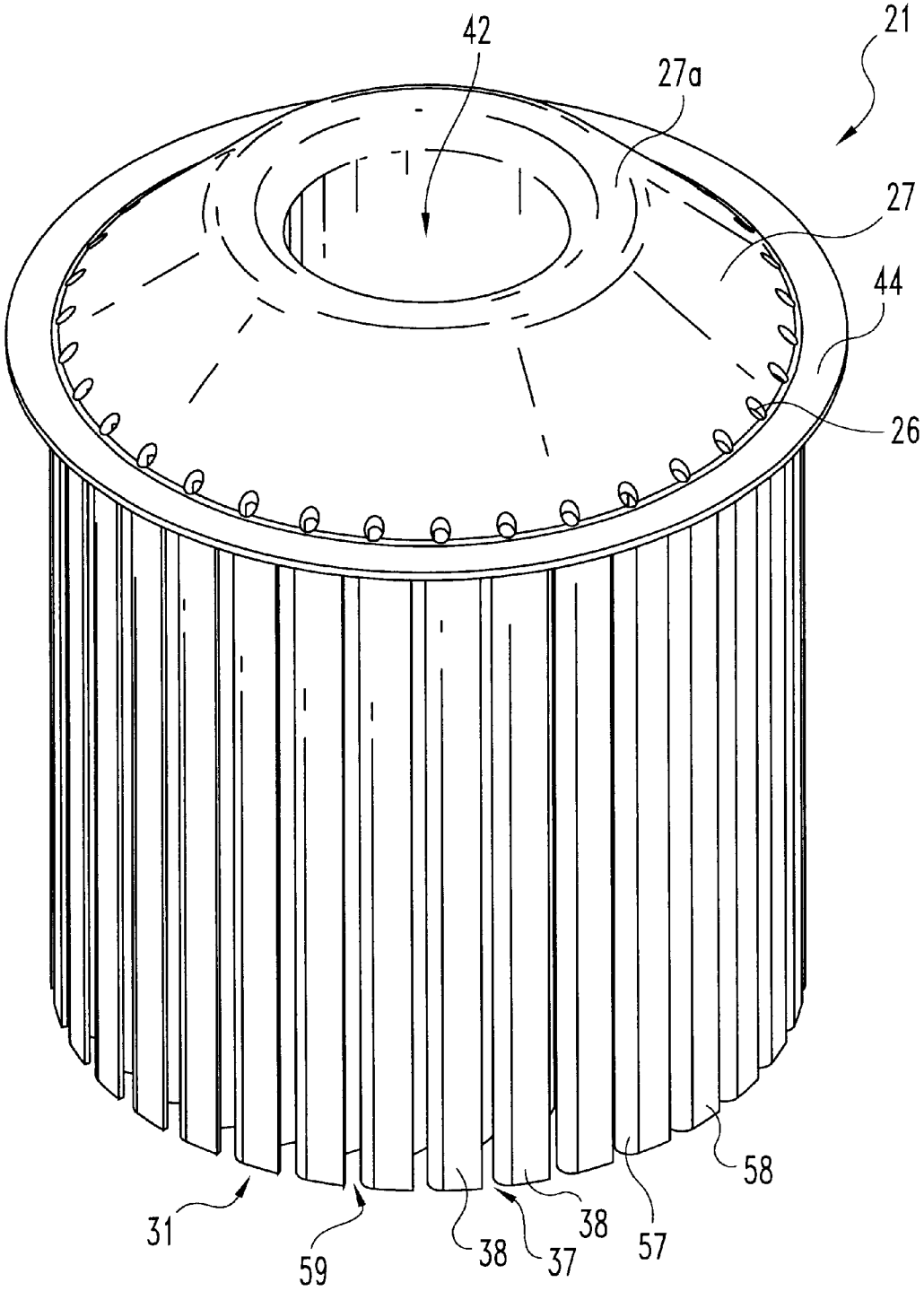
FIG. 3 is a top perspective view of a molded spiral vane module which comprises one portion of the FIG. 1 centrifuge according to the present invention.
Figure 4:
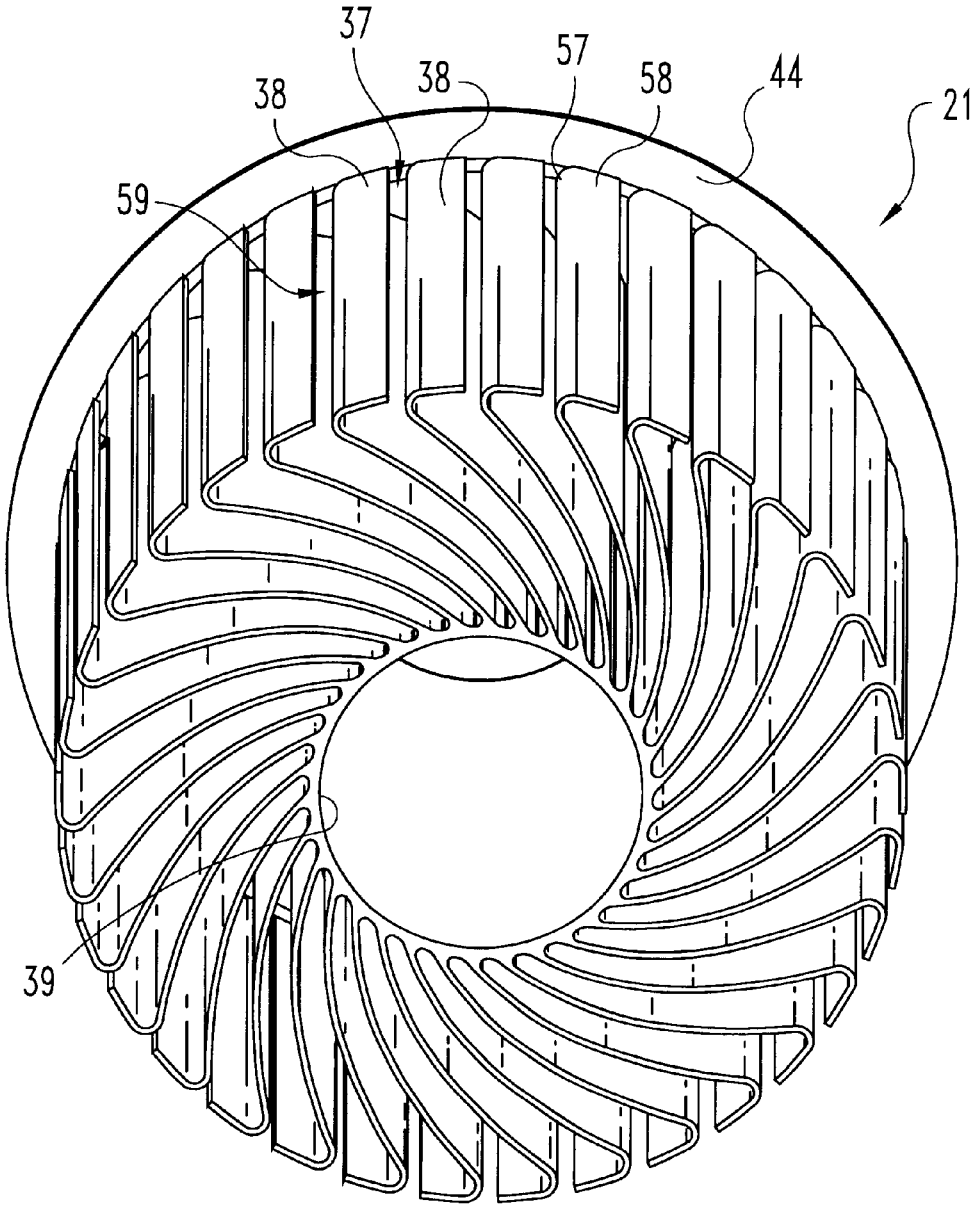
FIG. 4 is a bottom perspective view of the FIG. 3 spiral vane module.
Figure 5:
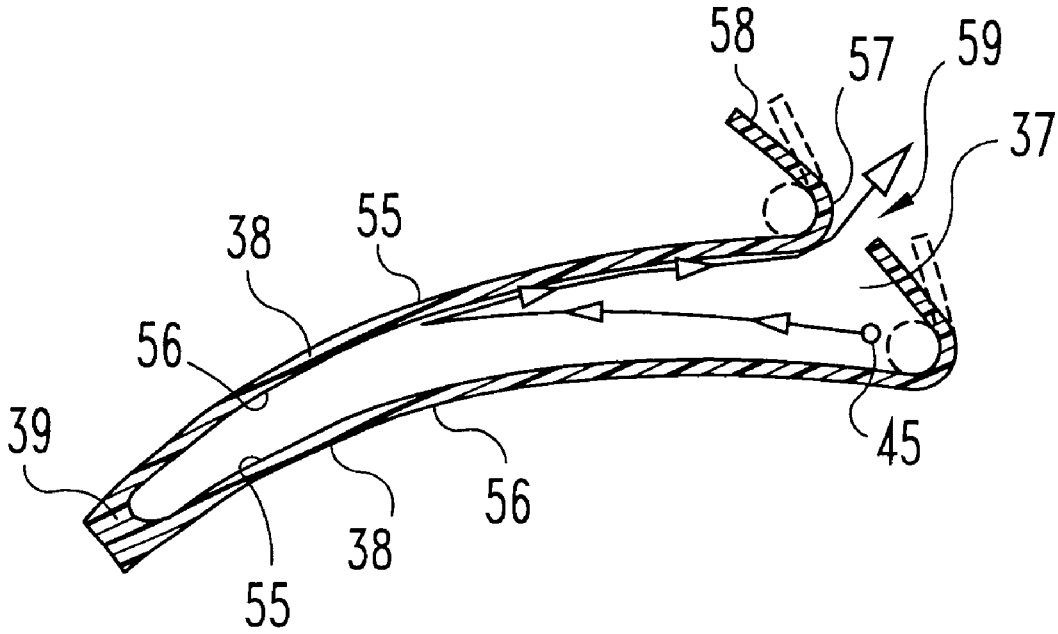
FIG. 5 is a partial, top plan, diagrammatic view of two spiral vanes of the FIG. 3 spiral vane module and the corresponding particle path.

With reference to FIGS. 3, 4, and 5, the structural details of the spiral vane module 21 are illustrated. FIGS. 3 and 4 are perspective views of the molded unitary design for module 21. FIG. 5 shows in a top plan view orientation and in diagrammatic form a pair of spiral vanes 38 and the gap 37 which is positioned therebetween. As partially described in the context of the flow path, the spiral vane module 21 includes thirty-four spiral vanes 38, each of which are of virtually identical construction and are integrally joined into a unitary, molded module. Each of these thirty-four spiral vanes 38 are integrally joined as part of the unitary construction along their uppermost edge to the underside or undersurface of top plate 27. Each spiral vane 38 extends away from the top plate in an axial direction toward its corresponding lower edge 31. The inner edge of each vane is cooperatively formed into the inner hub portion 39. Each spiral vane 38 includes a convex outer surface 55 and a concave inner surface 56. These surfaces define a spiral vane of substantially uniform thickness which measures approximately 1.0 mm (0.04 inches). The convex surface 55 of one vane in cooperation with the concave surface 56 of the adjacent vane defines the corresponding gap 37 between these two vanes. The width of the gap between vanes or its circumferential thickness increases as the vanes extend outwardly.

As each spiral vane 38 extends in a radial direction outwardly away from inner hub portion 39, it curves (curved portion 57) so as to partially encircle the corresponding inlet hole 26. As portion 57 extends tangentially away from the inlet hole location, it forms a turbulence shield 58. The turbulence shield 58 of one spiral vane 38 extends circumferentially in a counterclockwise direction based upon a top plan view toward the adjacent vane. There is a separation gap 59 defined between the free end or edge of one shield 58 on one vane and the curved portion 57 on the adjacent spiral vane. This separation gap is actually an axial or full length slit and measures approximately 1.8 mm (0.07 inches) in width in a circumferential direction. The slight curvature in each turbulence shield 58 in cooperation with the alternating separation gaps 59 creates a generally cylindrical form which defines the outermost surface of the spiral vane module 21 which is positioned beneath the top plate 27.

The curvature of each spiral vane from its inner edge to its outer curved portion has a unique geometry. A line 60 drawn from the axial centerline 60*a* of centrifuge rotation to a point of intersection 61 on any one of the thirty-four spiral vanes 38 forms a 45 degree included angle 60*b* with a tangent line 62 to the spiral vane curvature at the point of intersection (FIG. 2). This unique geometry applies to the convex and concave portions of the main body of each spiral vane and does not include either the curved portion 57 or the turbulence shield 58. The included angle, which in the preferred embodiment is 45 degrees, can be described as the spiral vane angle for the spiral vane module and for the corresponding centrifuge. It is envisioned that the preferred range for the included angle will be from 30 to 60 degrees. Where the earlier referenced '912 and '217 patents defined a cone angle, typically 45 degrees based on the slope or incline of the conical wall of each cone, the present invention defines a spiral vane angle.

In the process of the flow passing through gaps 37, the particulate matter to be separated drifts across the gap in an outward, generally radial path through the gap between adjacent vanes 38 due to a radial centrifugal force component. This particulate matter actually drifts upstream relative to the direction of flow in a manner similar to what occurs with the aforementioned cone-stack subassembly designs of the '912 and '217 patents. Once the particles comprising the particulate matter to be separated from the liquid flow reach the concave inward spiral surface of the corresponding vane (see FIG. 5), they migrate radially outward in the absence of flow velocity due to the fluid boundary layer. This radially outward path is in the direction of the sludge collection or quiescent zone 50. The particles then "fall out" of the spiral vane module through the continuous axial slits which are located between the circumferentially discontinuous turbulence shields of the corresponding spiral vanes (i.e., separation gaps 59). As described, the function of the turbulence shields is to reduce fluid interaction between the flow occurring in the gaps 37 and the sludge collection zone (quiescent zone 50). While this sludge collection zone is referred to as a "quiescent zone", that choice of terminology represents the preferred or desired condition. Ideally this sludge collection zone 50 would be completely quiescent so that there would be virtually no turbulence and no risk of any particulate matter being re-entrained back into the liquid flow. The turbulence shields 50, as viewed in a top plan orientation, presently are arranged so as to create or define a circular profile. However, it is contemplated that within the scope of the present invention, each of these turbulence shields 58 could be tilted outward slightly in order to allow particulate matter that may collect on the inner surface of each turbulence shield to also "slip out" into the collection zone. Since there is effectively a corner created at the location of the curved portion for each spiral vane, there could be a tendency for some particulate matter to accumulate in that comer. By tilting the turbulence shield portion, this comer is opened so that there is a greater tendency for any trapped particulate matter to be able to slide out into the sludge collection zone (quiescent zone 50). This alternative shape for the turbulence shield portion is illustrated by the broken line form in FIG. 5.

After the flow leaves the gaps between the adjacent spiral vanes and exits the clearance space adjacent the rotor hub, it passes to the jet nozzles where it is discharged at high velocity, causing the rotor to rotate at high speed due to the reaction force. As an alternative to this configuration, the specific rotor could be driven by a rotor-mounted impulse turbine. Additionally, the molded spiral vane module is "encapsulated" inside a sludge-containing liner shell/base plate assembly similar to that disclosed in U.S. Pat. No. 5,637,217. This particular configuration allows the quick the easy servicing of the centrifuge rotor since the sludge is contained entirely within the inner capsule and no scraping or cleaning is necessary. Alternatively, the spiral vane module of the present invention could replace a cone-stack subassembly included as part of a fully disposable centrifuge rotor design.

Figure 6:
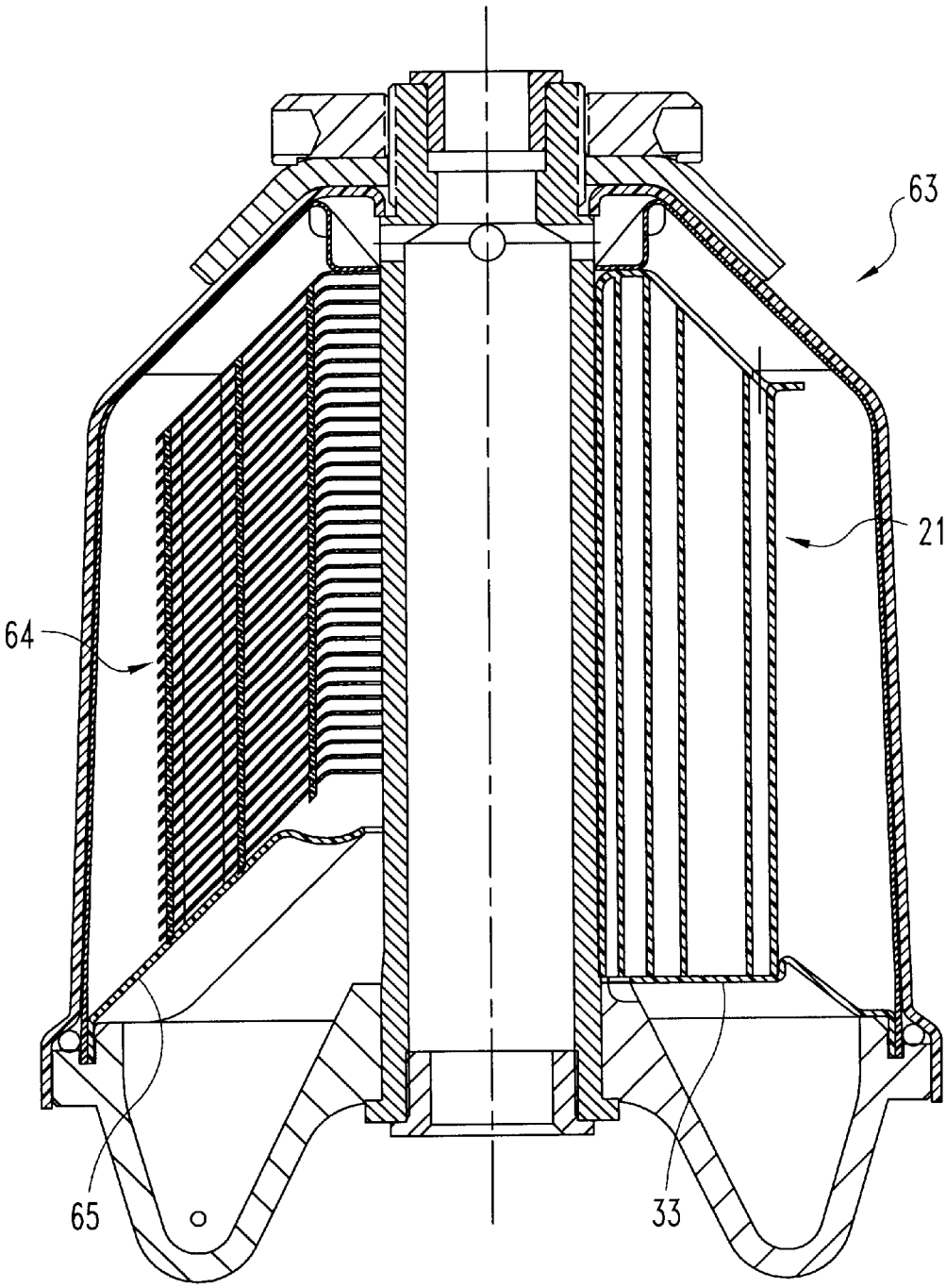
FIG. 6 is a diagrammatic, front elevational view, in full section showing a side-by-side comparison of a prior art cone-stack subassembly compared to the FIG. 3 spiral vane module according to the present invention.

Referring to FIG. 6, a diagrammatic side-by-side illustration is provided which shows on the left side of the centrifuge 63 one-half of a typical prior art cone-stack subassembly 64 and on the right side one-half of spiral vane module 21 according to the present invention. The FIG. 6 illustration is intended to reinforce the previous description which indicated that the spiral vane module 21 of the present invention is or can be a substitution for the prior art cone-stack assembly as depicted in U.S. Pat. Nos. 5,575,912; 5,637,217; 6,017,300; and 6,019,717. While the design of the corresponding base plates 65 and 33 changes slightly between the two styles, the balance of the centrifuge construction is virtually identical for each style.

Figure 7A:
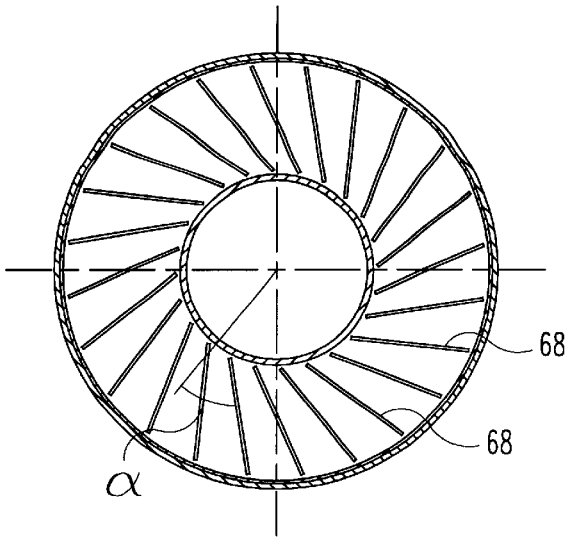
FIG. 7A is a diagrammatic, top plan view of an alternative vane style according to the present invention.
Figure 7B:
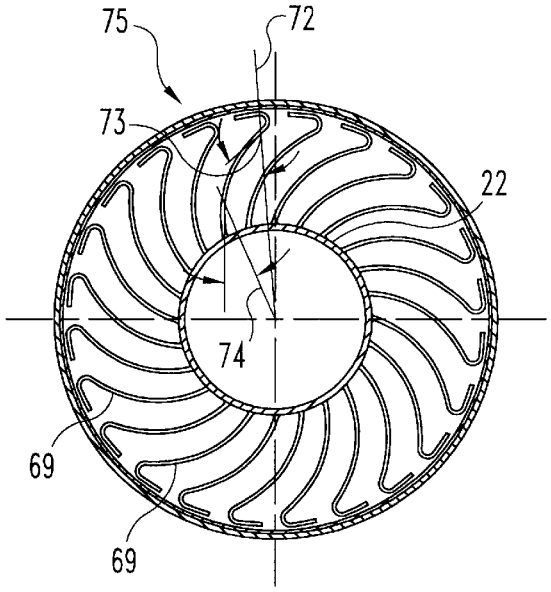
FIG. 7B is a diagrammatic, top plan view of yet another alternative vane style according to the present invention.
Figure 7C:
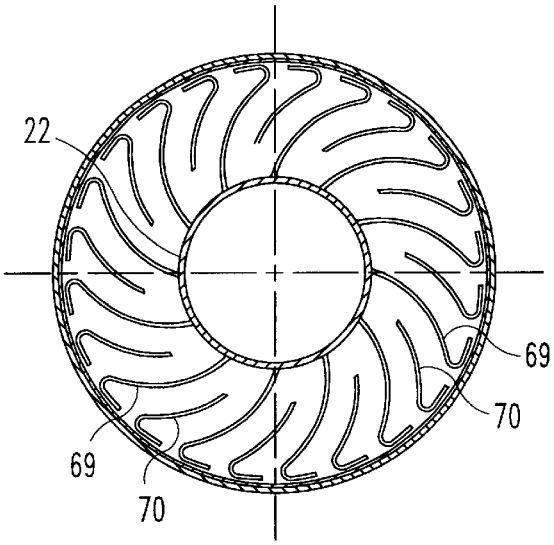
FIG. 7C is a diagrammatic, top plan view of a further alternative vane style according to the present invention.

Referring to FIGS. 7A, 7B, and 7C, three alternative design embodiments for the style of spiral vanes to be used as part of the spiral vane module are illustrated. While still keeping within the same context of the theory and functioning of the present invention and while still maintaining the concept of replacing the prior art cone-stack subassembly with a spiral vane module, any one of these alternative designs can be utilized.

In FIG. 7A, the curved spiral vanes 38 of module 21 are replaced with vanes 68 having substantially flat, planar surfaces. The vanes 68 are offset so as to extend outwardly, but not in a pure radial manner. The top plan view of FIG. 7A shows a total of twenty-four vanes or linear plates 68, but the actual number can be increased or decreased depending on such variables as the overall size of the centrifuge, the viscosity of the liquid, and the desired efficiency as to particle size to be separated. The pitch angle ($\alpha$) or incline of each plate is another variable. While each plate 68 is set at the same radial angle ($\alpha$), the selected angle can vary. The choice for the angle depends in part on the speed of rotation of the centrifuge.

In FIG. 7B, the individual vanes 69 are curved, similar to the style of vanes 38, but with a greater degree of curvature, i.e., more concavity. Further, each individual vane 69 has a gradually increasing curvature as it extends away from bearing tube 22. This vane shape is described as a "hyper-spiral" and is geometrically defined in the following manner. First, using a radial line 72 drawn from the axial centerline of bearing tube 22 which is also the axial centerline of module 21, have this line intersect a point 73 on the convex surface of one vane. Drawing a tangent line 74 to this point of intersection 73 defines an included angle 75 between the radial line and the tangent line. The size of this included angle 75 increases as the point of intersection 73 moves farther away from bearing tube 22. The theory with this alternative spiral vane embodiment is to shape each vane so that there is a constant particle slip rate as the g-force increases proportionally with the distance from the axis of rotation. With the exception of the curvature geometry for each vane 69, the spiral vane module diagrammatically illustrated in FIG. 7B is identical to spiral vane module 21.

In FIG. 7C, the spiral vane design for the corresponding module is based on the vane 69 design of FIG. 7B with the addition of partial splitter vane 70. There is one splitter vane 70 between each pair of full vanes 69 and the size, shape, and location of each one is the same throughout the entire module. The splitter vanes 70 are similar to those used in a turbocharger compressor in order to increase the total vane surface area whenever the number of vanes and vane spacing may be limited by the close spacing at the hub inside diameter.

Other design variations or considerations for the present invention include variations for the manufacturing and molding methods. For example, the generally cylindrical form of the molded vanes (or plates) can be extruded as a continuous member and then cut off at the desired axial length or height and assembled to a separately manufactured, typically molded, top plate. The top plate is molded with the desired inlet holes and divider shields as previously described as part of module 21.

Another design variation which is contemplated for the present invention is to split the spiral vane module into two parts, a top half and a cooperating bottom half. This manufacturing technique would be used to avoid molding difficulties that may arise from close vane-to-vane spacing. After fabrication of the two halves, they are joined together into an integral module. In this approach, it is envisioned that the top plate will be molded in a unitary manner with the top half of the vane subassembly and that the base plate will be molded in a unitary manner with the bottom half of the vane subassembly.

Figure 8:
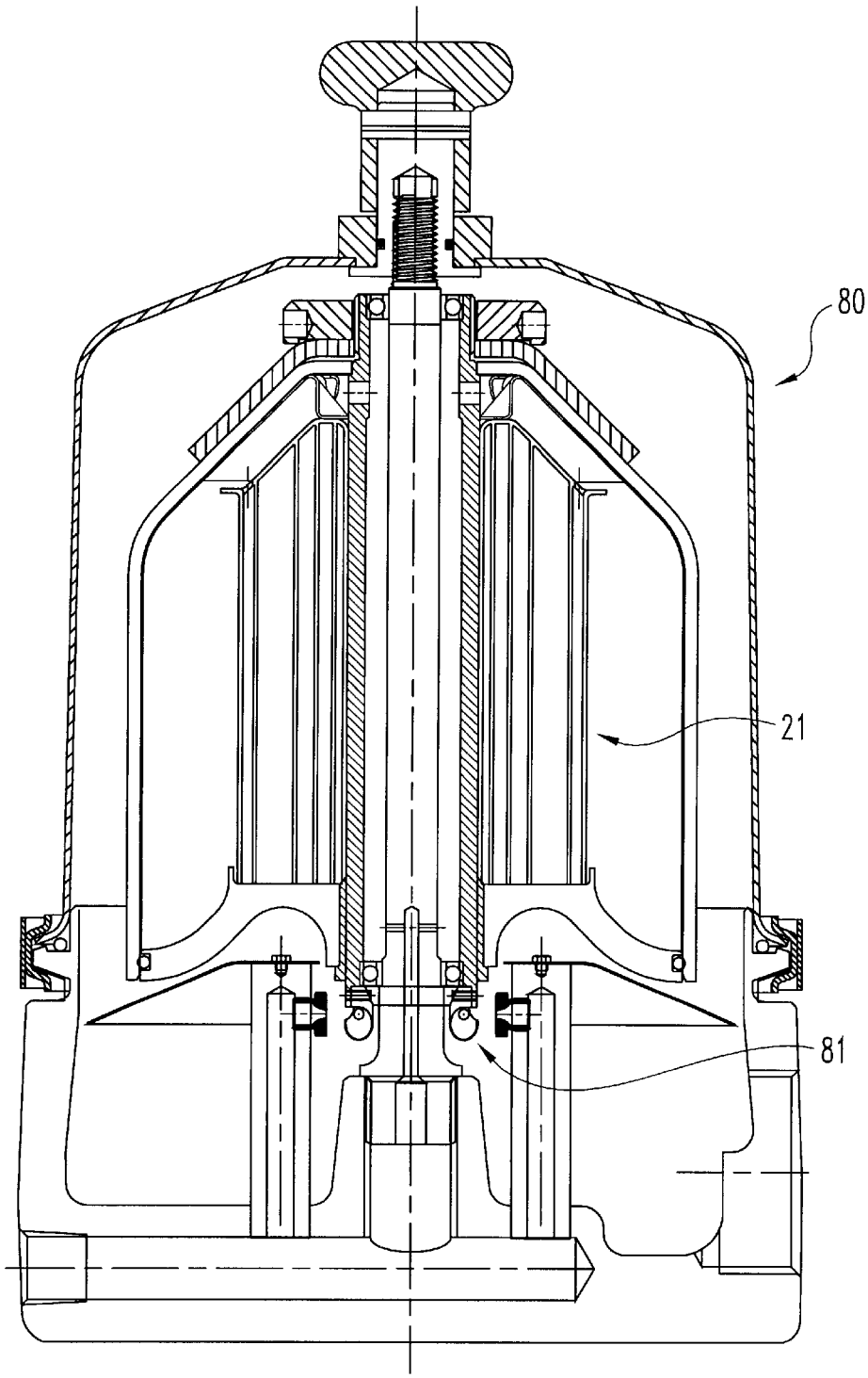
FIG. 8 is a front elevational view in full section of an impulse-turbine driven centrifuge according to another embodiment of the present invention.
Figure 8A:
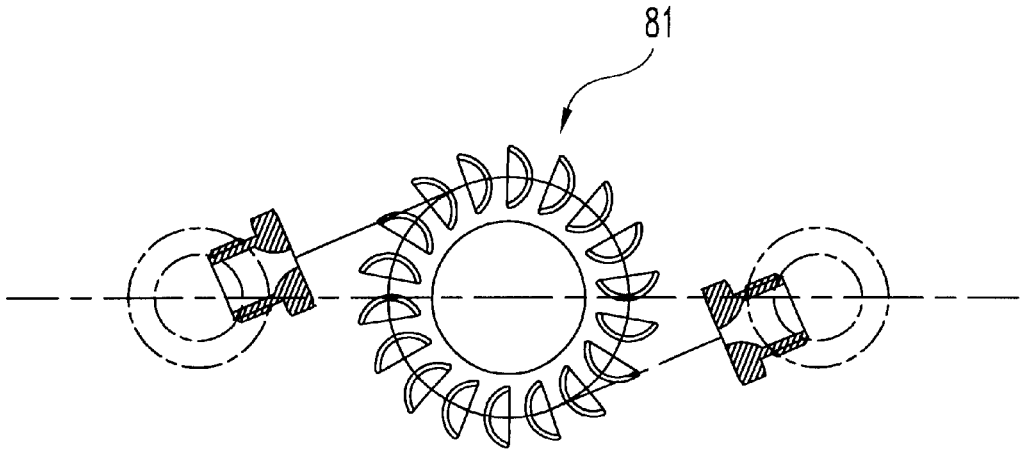
FIG. 8A is a diagrammatic top plan view of the impulse-turbine arrangement associated with the FIG. 8 centrifuge.

The spiral vane module 21 and/or any of the three alternative (spiral) vane styles of FIGS. 7A, 7B, and 7C can be used in combination with an impulse-turbine driven style of centrifuge 80 as illustrated in FIGS. 8 and 8A. For this illustration, spiral vane module 21 has been used. The impulse-turbine arrangement 81 is diagrammatically illustrated in FIG. 8A.

Figure 9:
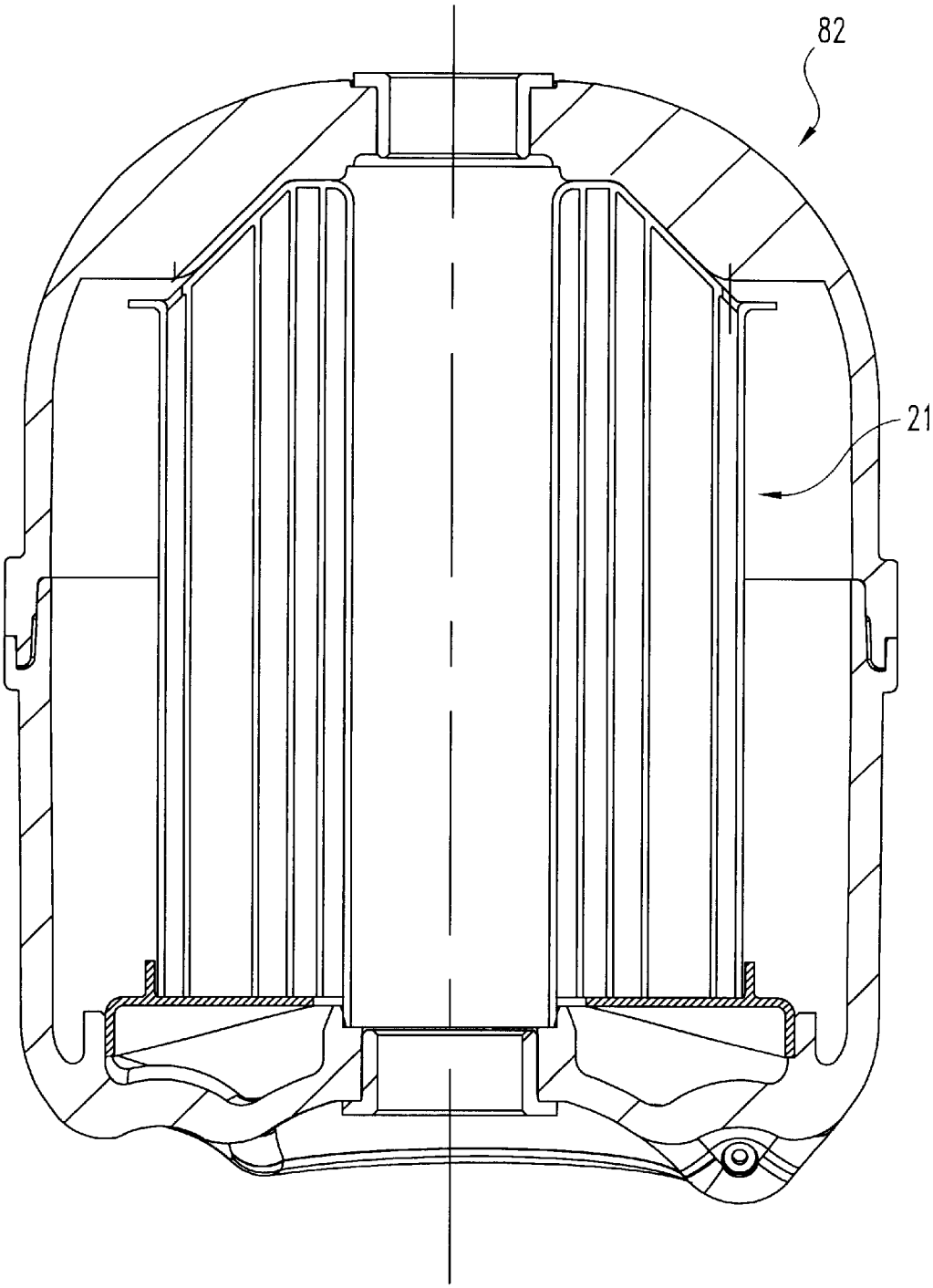
FIG. 9 is a front elevational view in full section of a disposable rotor according to another embodiment of the present invention.

It is also envisioned that spiral vane module 21 and/or any of the three alternative (spiral) vane styles of FIGS. 7A, 7B, and 7C can be used as part of a disposable rotor 82 which is suitable for use with a cooperating centrifuge (not illustrated). Spiral vane module 21 has been included in the FIG. 9 illustration. It is also envisioned that the disposable rotor 82 of FIG. 9 can be used in combination with an impulse-turbine driven style of centrifuge, such as centrifuge 80.

Figure 10:
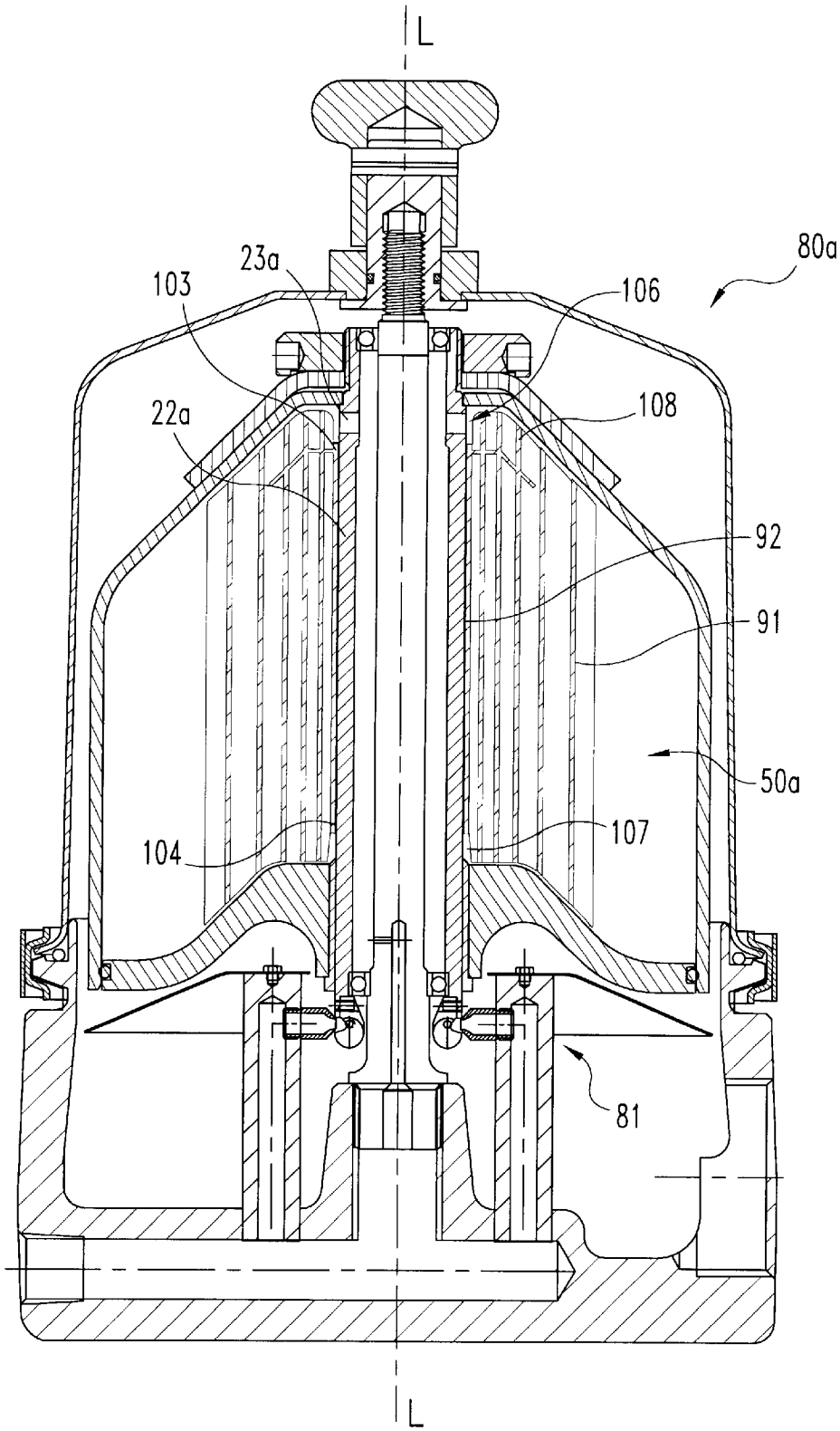
FIG. 10 is a front elevational view in full section of an impulse-turbine driven centrifuge according to another embodiment of the present invention.

An impulse-turbine driven style centrifuge 80*a* with impulse-turbine arrangement 81 is diagrammatically illustrated in FIG. 10. The centrifuge 80*a* incorporates a spiral vane module 91 according to another embodiment of the present invention. As should be appreciated, the spiral vane model 91 can be used in other types of centrifuges. Like the above-described centrifuges, centrifuge 80*a* has a bearing tube 22*a* that defines a plurality of top tube apertures 23*a*. During operation, the top tube apertures 23*a* supply fluid to the spiral vane module 91.

Figure 11:
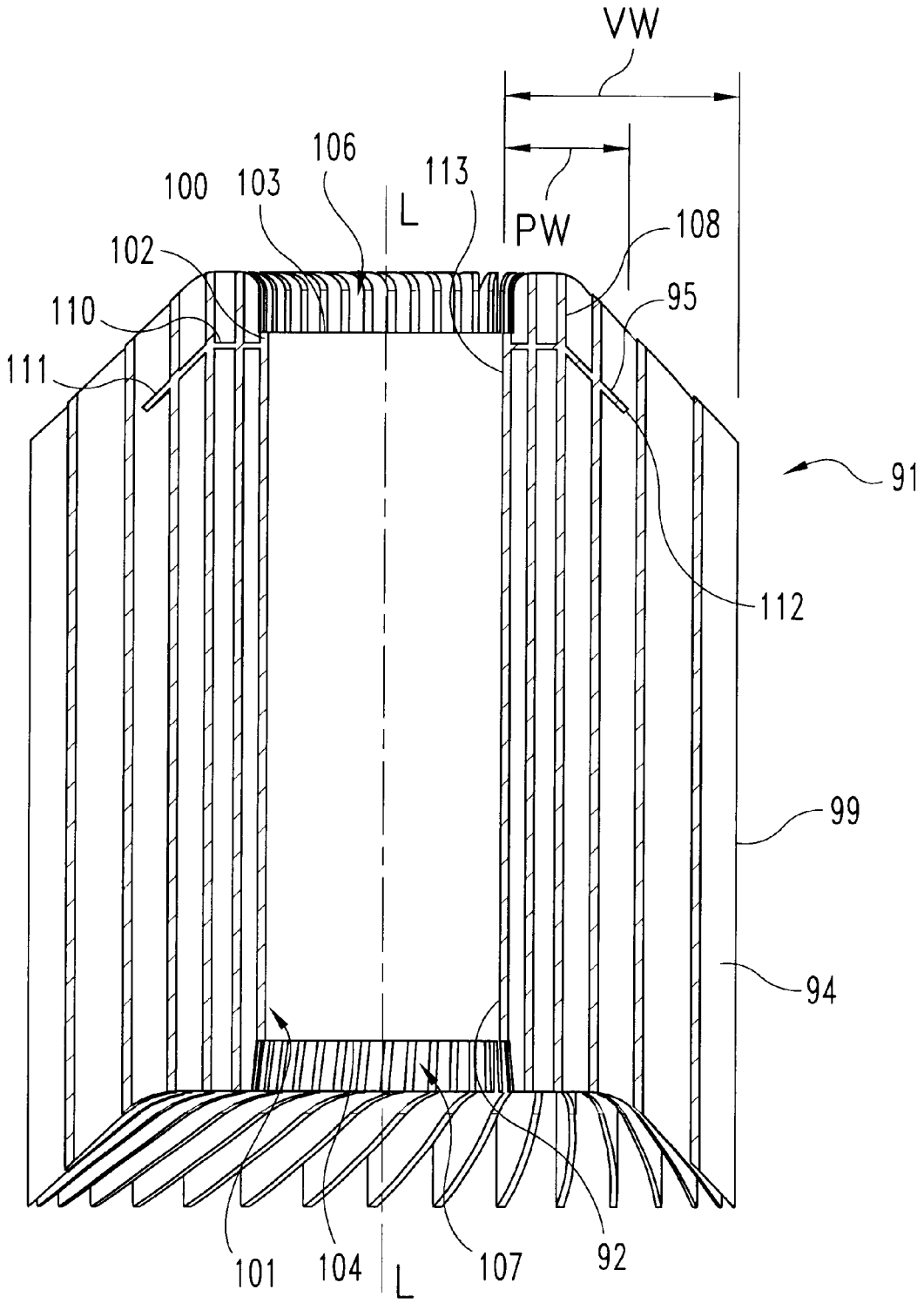
FIG. 11 is a front elevational view in full section of a spiral vane module used in the FIG. 10 centrifuge.
Figure 12:
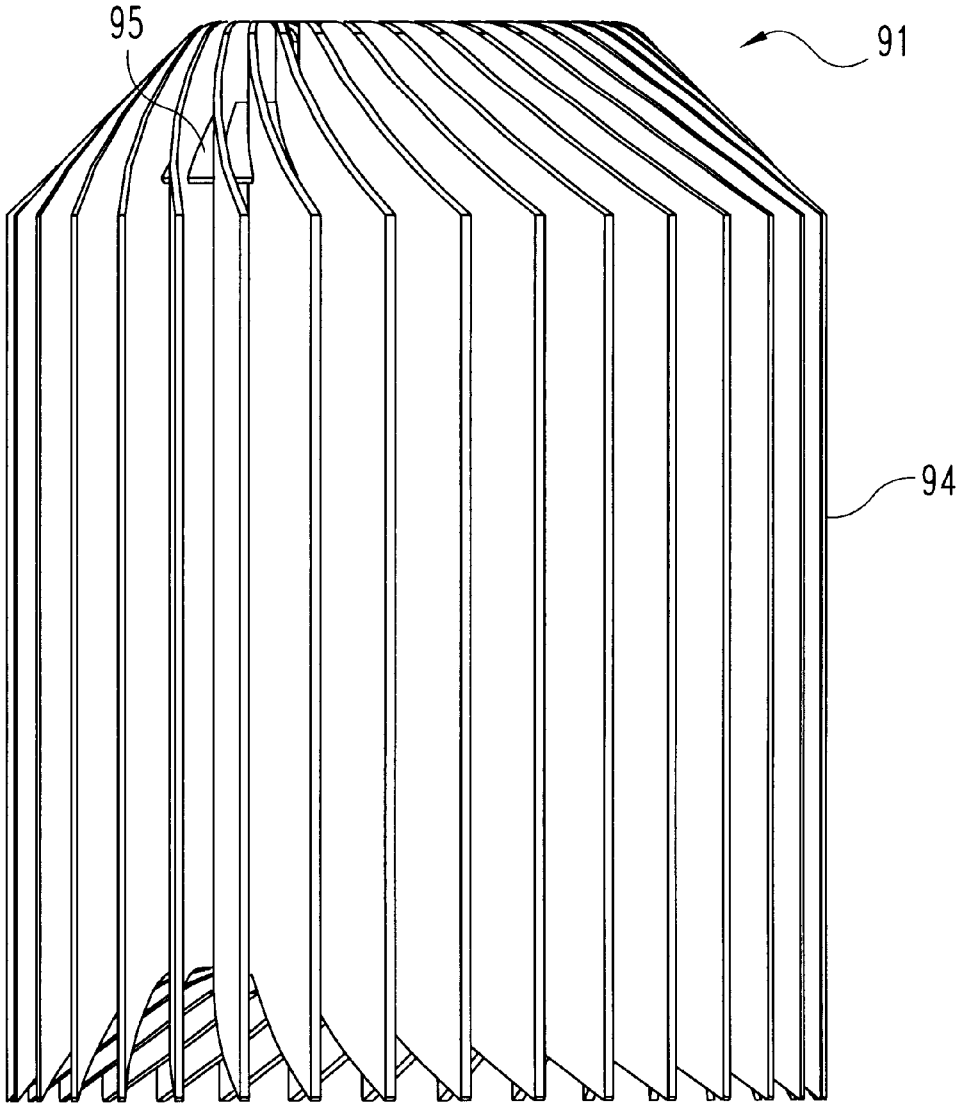
FIG. 12 is a front elevational view of the FIG. 11 spiral vane module.
Figure 13:
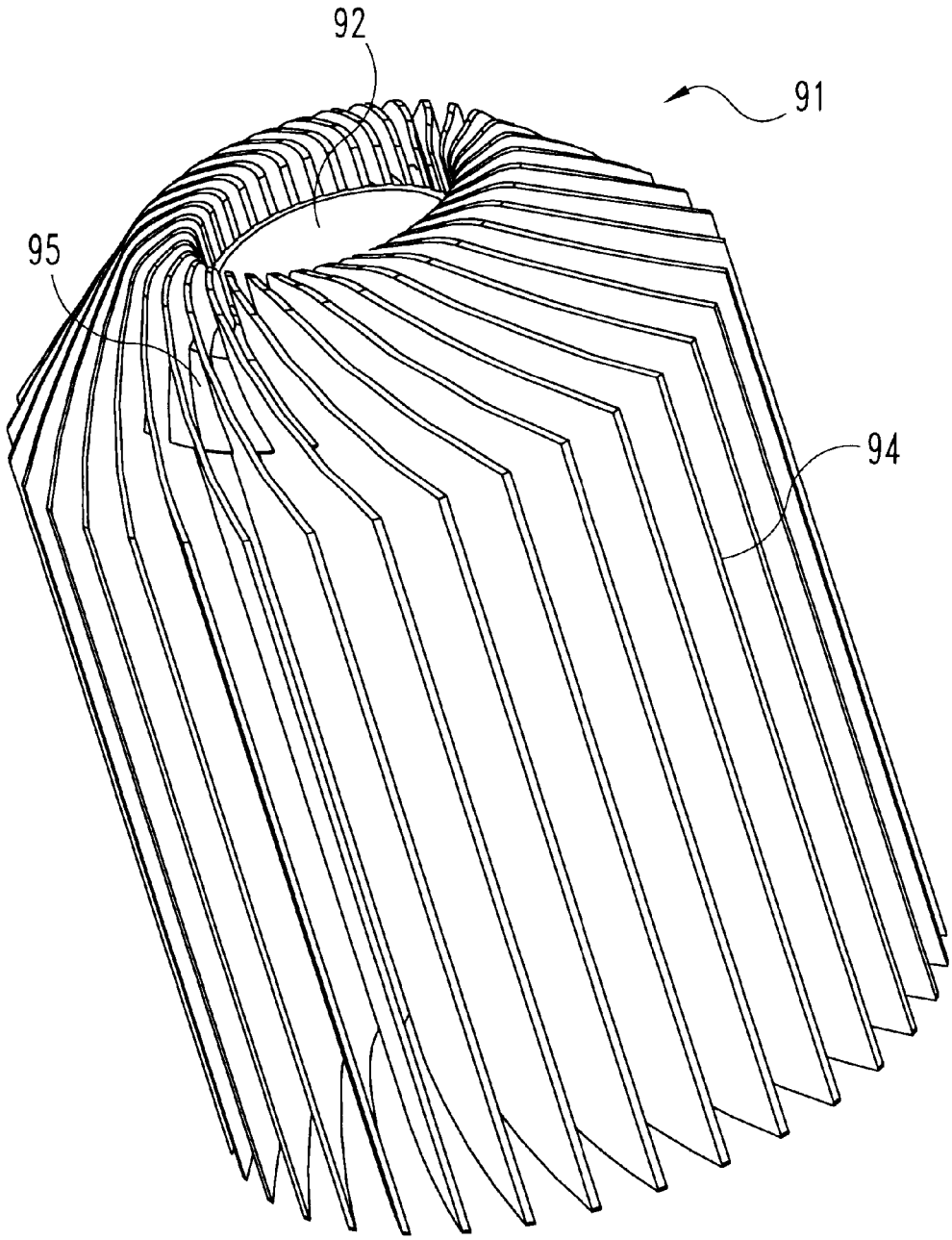
FIG. 13 is a perspective view of the FIG. 11 spiral vane module.
Figure 14:
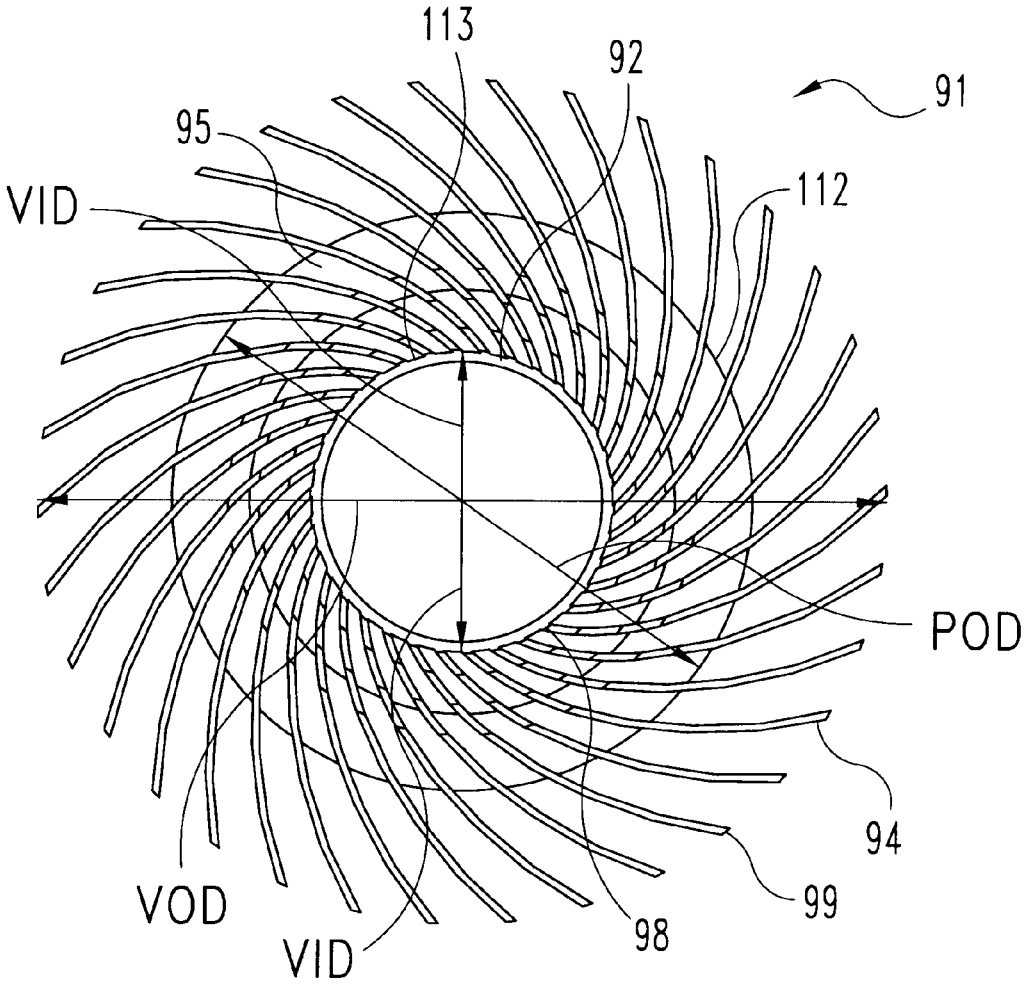
FIG. 14 is a top plan view of the FIG. 11 spiral vane module.

As illustrated in FIGS. 11–14, the spiral vane module 91 includes a centertube or hub portion 92, a plurality of vanes 94 and a top plate 95. In FIG. 11, the centertube 92 extends along the central axis of rotation L of the centrifuge 80*a*. The vanes 94 extend in a radially outward direction from the centertube 92, and the vanes 94 extend along the central axis of rotation L. As shown in FIG. 14, each vane 94 has an inner radial edge 98 attached to the centertube 92 and an outer radial edge 99 extending away from the centertube 92. Together the inner radial edges 98 of the vanes 94 define a vane inner diameter VID, and the outer radial edges 99 define a vane outer diameter VOD. In one form, the center tube 92, vanes 94 and top plate 95 are integrally molded together such that the spiral vane module 91 is a unitary structure. As illustrated, the vanes 94 have a spiral shape, but it should be appreciated that the vanes 94 can also be shaped/configured in other manners, such as the configurations described above and/or illustrated in FIGS. 7A–C.

Referring again to FIG. 11, the top plate 95 is attached at a first (inlet) end portion 100 of the centertube 92, which is opposite a second (outlet) end portion 101 of the centertube 92. A small portion 102 of the centertube 92 extends above the top plate 95. As should be appreciated, the top plate 95 can be flush with upper edge 103 of the centertube 92. As depicted in FIG. 10, the centertube 92 does not extend along the entire length of the vanes 91. Rather, at the first end portion 100 of the centertube 92, the upper edge 103 of the centertube 92 along with the inner radial edges 98 of the vanes 94 define a plurality of fluid inlet passages 106. Similarly, at second end portion 101, lower edge 104 of the center tube 92 along with the inner radial edges 98 of the vanes 94 define a plurality of fluid outlet passages 107. At the fluid inlet passages 106, upper portions 108 of the vanes 94 extend through and above the top plate 95. During operation of the centrifuge 80*a*, the upper portions 108 of the vanes 94 prevent fluid slippage along the top plate 95.

With reference to FIG. 11, the top plate 95 has a generally conical shape that includes an inner flat portion 110, an outer angled portion 111, a peripheral outer edge 112, and an inner edge 113 attached to the centertube 92. Retention of super-fine (sub-micron) particle collection occurs when fluid motion relative to the rotor's rotation is minimized. It was discovered that the minimum average relative velocity in sludge collection zone 50*a* (FIG. 10) of the centrifuge 80*a* occurs when the outer edge 112 of the top plate 95 is located approximately between one-quarter (¼) to three-quarters (¾) the distance between the vane inner diameter VID and the vane outer diameter VOD (FIG. 14). In particular, the relative average velocity in the sludge collection zone 50*a* is minimized when the top plate 95 has an outer diameter POD that is approximately half way between the vane inner diameter VID and the vane outer diameter VOD. In other words, the optimal top plate 95 diameter is approximately the average of the spiral vane inner diameter VID (i.e., hub diameter) and the spiral vane outer diameter VOD such that the outer edge 112 of the top plate 95 terminates at half the length of the vanes 94 as measured along a radial line from the central axis of rotation L. For example, if the spiral vane inner diameter VID was two inches (2"), and the spiral vane outer diameter (VOD) was five inches (5"), the optimal diameter would be approximately 3.5 inches ((5"+2")÷2=3.5"). Another view of this relationship is illustrated in FIG. 11, where top plate width PW of the top plate 95 is half of the width VW of the vanes 94.

Figure 15:
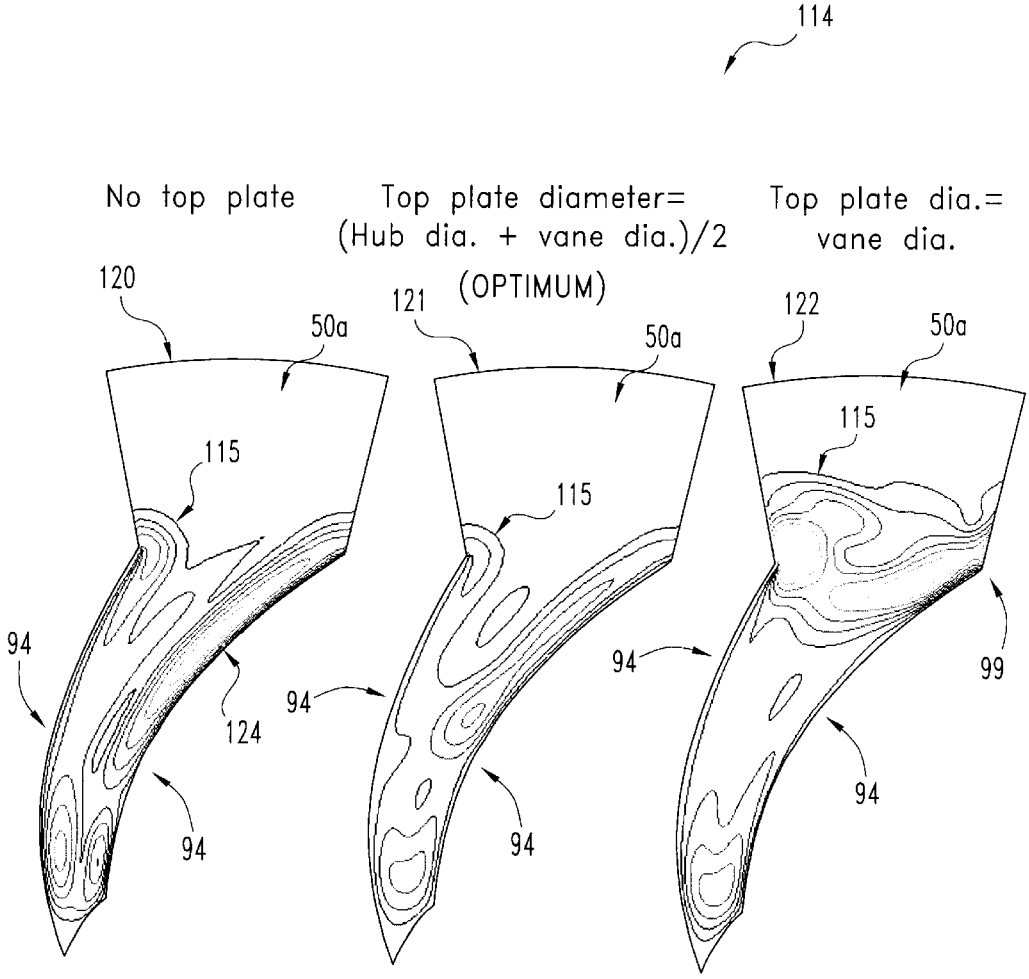
FIG. 15 is a computational fluid dynamics chart illustrating the relative fluid velocities between adjacent spiral vanes for three design alternatives.

In FIG. 15, a computational fluid dynamics (CFD) graph 114 illustrates this advantage of having the outer edge of the top plate 95 positioned between the inner radial edges 98 and the outer radial edges 99 of the vanes 94. The graph 114 shows fluid velocity gradients 115 in the fluid passageways between adjacent spiral vanes 94 under three different conditions. These fluid velocity gradients 115 are viewed from a cutting plane that is perpendicular to the central axis of rotation L and that is positioned at the mid-axial point of the rotor (i.e., half way between the top plate 95 and the bottom outlet). In graph 114, graphic portion 120 illustrates the distribution of the velocity gradients 115 when no top plate 95 is used in the centrifuge 80*a*. Graphic portion 121 illustrates the velocity gradients 115 when the outer diameter POD of the top plate 95 is approximately half way between the vane inner diameter VID and the vane outer diameter VOD. Graphic portion 122 illustrates the distribution of velocity gradients 115 when the top plate diameter POD equals the vane outer diameter VOD.

As compared to graphic 121, the no top plate and full top plate designs shown by graphic portions 120 and 122, respectively, each have a large number of velocity gradients 115. When there is no top plate 95 (graphic portion 120), the volume average relative velocity magnitude for the entire axial length of the fluid channel is 0.023 meters per second. In the illustrated example, the spiral vane module 91 is rotated in a counterclockwise direction such that a pressure face 124 is formed on the leading surface of each vane 94. As shown in graphic portion 120, a large number of velocity gradients exist on the pressure face 124 of the spiral vanes 94 with the no top plate 95 design. As should be appreciated, the spiral vane module 91 can be adapted to rotate in a clockwise fashion. When the top plate outer diameter POD equals the vane outer diameter VOD (graphic portion 122), the volume average relative velocity magnitude is 0.021 meters per second. As depicted in graphic portion 122, a large number of velocity gradients 115 are formed at the outer edges 99 of the vanes 94 where the top plate 95 terminates. When the top plate diameter POD is halfway between the vane inner diameter VID and the vane outer diameter VOD (graphic portion 121), the number of velocity gradients 115 are reduced at both the pressure face 124 and the outer edges 99 of the vanes 94. With this design, the average velocity of the fluid is minimized to 0.006 meters per second. This overall reduction in fluid velocity improves super-fine particle collection.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge, comprising:

a separation vane module having a central axis of rotation, said separation vane module including a hub portion extending along said central axis of rotation, a plate defining a plurality of inlet holes at one end of said hub portion, and a plurality of vanes each having an inner radial edge attached to said hub portion, said vanes extending in an outward radial direction from said hub portion, said vanes extending from said plate along said central axis of rotation.

2. The centrifuge of claim 1, wherein:

adjacent pairs of said vanes each defines a separation gap therebetween; and said inlet holes are positioned to correspond with each of said separation gaps.

3. The centrifuge of claim 2, wherein each of said vanes includes a curved portion that partially encircles one of said inlet holes.

4. The centrifuge of claim 1, wherein said vanes are integrally formed with said plate and said hub portion.

5. The centrifuge of claim 1, wherein said plate has a conical form.

6. The centrifuge of claim 1, wherein said vanes have a spiral shape.

7. The centrifuge of claim 6, wherein a radially extending line from said central axis of rotation that intersects one of said vanes at a point of intersection and a tangent line from said point of intersection define an angle between 30 to 60 degrees.

8. The centrifuge of claim 1, wherein said vanes have a hyper-spiral shape.

9. The centrifuge of claim 1, wherein said vanes have a flat shape.

10. The centrifuge of claim 1, further comprising one or more partial splitter vanes provided between adjacent pairs of said vanes.

11. The centrifuge of claim 1, wherein said vanes are equally spaced.

12. The centrifuge of claim 1, wherein said plate includes a divider shield positioned at an outer peripheral edge of said plate.

13. The centrifuge of claim 1, wherein adjacent pairs of said vanes each define a gap therebetween, wherein said gap has a width that increases as said gap extends in an outer radial direction with respect to said axis of rotation.

14. The centrifuge of claim 1, wherein each of said vanes has a turbulence shield to reduce particulate re-entrainment.

15. The centrifuge of claim 1, further comprising a rotor hub slidingly received in said hub portion.

16. A centrifuge, comprising:

a separation vane module having a central axis of rotation, said separation vane module including a hub portion extending along said central axis of rotation, a plurality of vanes extending in an outward radial direction from said hub portion, said vanes extending along said central axis of rotation, and wherein each of said vanes has an outer peripheral edge that circumferentially extends with respect to said central axis of rotation and forms a turbulence shield to reduce particulate re-entrainment.

17. The centrifuge of claim 16, further comprising a plate provided at one end of said hub portion.

18. The centrifuge of claim 17, wherein said plate defines a plurality of inlet holes.

19. The centrifuge of claim 17, wherein said plate has an outer edge located between said hub portion and said outer peripheral edges of said vanes.

20. The centrifuge of claim 19, wherein said outer edge of said plate is located halfway between said hub portion and said outer peripheral edges of said vanes.

21. The centrifuge of claim 17, wherein said vanes are integrally formed with said plate and said hub portion.

22. The centrifuge of claim 17, wherein said plate includes a divider shield positioned at an outer edge of said plate.

23. The centrifuge of claim 16, wherein:

said vanes have a spiral shape; and a radially extending line from said central axis of rotation that intersects one of said vanes at a point of intersection and a tangent line from said point of intersection define an angle between 30 to 60 degrees.

24. The centrifuge of claim 16, wherein said vanes have a hyper-spiral shape.

25. The centrifuge of claim 16, further comprising a rotor hub slidingly received in said hub portion.

26. A centrifuge, comprising:

a separation vane module having a central axis of rotation, said separation vane module including a hub portion extending along said central axis of rotation, a plurality of curved vanes extending in an outward radial direction from said hub portion, said vanes extending along said central axis of rotation, and wherein each of said vanes has a hyper-spiral shape in which a radially extending line from said axis of rotation intersects one of said vanes at a point of intersection, said radially extending line and a tangent line from said point of intersection define an angle that gradually increases as said point of intersection moves away from said hub portion.

27. The centrifuge of claim 26, further comprising a plate formed at one end of said hub portion.

28. The centrifuge of claim 27, wherein said plate defines a plurality of inlet holes.

29. The centrifuge of claim 27, wherein:

said vanes have outer peripheral edges; and said plate has an outer edge located between said hub portion and said outer peripheral edges of said vanes.

30. The centrifuge of claim 29, wherein said outer edge of said plate is located halfway between said hub portion and said outer peripheral edges of said vanes.

31. The centrifuge of claim 26, wherein each of said vanes has a turbulence shield to reduce particulate re-entrainment.

32. The centrifuge of claim 26, further comprising a rotor hub slidingly received in said hub portion.

33. A centrifuge, comprising:

a separation vane module having a central axis of rotation, said separation vane module including a hub portion extending along said central axis of rotation, a plate provided at one end portion of said hub portion, a plurality of vanes each having an inner radial edge attached to said hub portion and an outer radial edge, said vanes extending in an outward radial direction from said hub portion, said vanes extending from said plate along said central axis of rotation, and wherein said plate has an outer edge that terminates at one quarter to three quarters the distance between said inner radial edges and said outer radial edges of said vanes.

34. The centrifuge of claim 33, wherein said plate terminates halfway between said inner radial edges and said outer radial edges of said vanes.

35. The centrifuge of claim 33, wherein said vanes have a hyper-spiral shape.

36. The centrifuge of claim 33, wherein each of said vanes has a turbulence shield to reduce particulate re-entrainment.

37. The centrifuge of claim 33, wherein said vanes are integrally formed with said plate and said hub portion.

38. The centrifuge of claim 33, wherein said plate has a conical form.

39. The centrifuge of claim 33, further comprising one or more partial splitter vanes provided between adjacent pairs of said vanes.

40. The centrifuge of claim 33, wherein said vanes are equally spaced.

41. The centrifuge of claim 33, wherein each of said vanes has a portion that extends above said plate to reduce fluid slippage along said plate.

42. The centrifuge of claim 33, further comprising a rotor hub slidingly received in said hub portion.

43. A centrifuge, comprising:

a rotor shell; and a separation vane module enclosed in said rotor shell, said separation vane module having a central axis of rotation, said separation vane module including a hub portion extending along said central axis of rotation, a plate provided at one end portion of said hub portion, a plurality of vanes each having an inner radial edge attached to said hub portion and an outer radial edge, said vanes extending in an outward radial direction from said hub portion, said vanes extending from said plate along said central axis of rotation, wherein a sludge collection zone is defined between said rotor shell and said outer radial edges of said vanes, and wherein said plate has an outer edge that terminates at one quarter to three quarters the distance between said inner radial edges and said outer radial edges of said vanes to minimize an average relative velocity of fluid in said sludge collection zone.

44. The centrifuge of claim 43, wherein said plate terminates halfway between said inner radial edges and said outer radial edges of said vanes.

45. The centrifuge of claim 44, wherein said vanes have a spiral shape.

46. The centrifuge of claim 43, wherein said vanes have a spiral shape.

47. A centrifuge, comprising:

a rotor shell; and a separation vane module enclosed in said rotor shell, said separation vane module having a central axis of rotation, said separation vane module including a hub portion extending along said central axis of rotation, a plate provided at one end portion of said hub portion, a plurality of vanes each having an inner radial edge attached to said hub portion and an outer radial edge, said vanes extending in an outward radial direction from said hub portion, said vanes extending from said plate along said central axis of rotation, and wherein each of said vanes has a portion that extends above said plate to reduce fluid slippage along said plate.

* * * * *